US008766130B2

(12) United States Patent
Prohaska et al.

(10) Patent No.: US 8,766,130 B2
(45) Date of Patent: Jul. 1, 2014

(54) ARC EXTINCTION APPARATUS AND DC SWITCH APPARATUS

(75) Inventors: Richard Donald Prohaska, Cleveland, TN (US); Randal Derek Gazdecki, Cleveland, TN (US); Warren Clift Sipe, Cleveland, TN (US)

(73) Assignee: Eaton Corporation, Cleveland, OH (US)

( * ) Notice: Subject to any disclaimer, the term of this patent is extended or adjusted under 35 U.S.C. 154(b) by 275 days.

(21) Appl. No.: 13/286,464

(22) Filed: Nov. 1, 2011

(65) Prior Publication Data

US 2013/0105444 A1 May 2, 2013

(51) Int. Cl.
*H01H 9/44* (2006.01)

(52) U.S. Cl.
USPC ..... 218/27; 218/40

(58) Field of Classification Search
USPC ..... 355/207; 218/27, 40
See application file for complete search history.

(56) References Cited

U.S. PATENT DOCUMENTS 2,625,628 A * 1/1953 Wood ..... 218/40
2,875,304 A * 2/1959 White ..... 218/26
3,054,876 A * 9/1962 Wood et al. ..... 218/28
5,859,578 A * 1/1999 Arnold ..... 337/110
8,164,018 B2 * 4/2012 Yang ..... 218/15
2011/0193664 A1 * 8/2011 Fisher et al. ..... 335/207
2012/0067849 A1 * 3/2012 Nazeri ..... 218/27

OTHER PUBLICATIONS

Siemens Industry, Inc., Heavy Duty Photovoltaic Disconnect Switches, www.usa.siemens.com/switches, 2010, 4 pp.

* cited by examiner

*Primary Examiner* — Truc Nguyen
(74) *Attorney, Agent, or Firm* — Eckert Seamans Cherin & Mellott, LLC; Brij K. Agarwal

(57) ABSTRACT

An improved arc extinction apparatus that can be used in an improved DC switch apparatus includes a pair of magnetic field elements in the exemplary form of permanent magnets to apply Lorentz forces to the arcs. The magnetic fields are arranged in the vicinity of the air gaps that form between the ends of a pivoting conductor and a pair of contacts such that the system is optimized to extinguish an arc at one air gap when current is flowing through the conductor in a first direction and is further optimized to extinguish an arc at the other air gap when current is flowing in an opposite direction through the conductor. This is accomplished by providing a magnet at each air gap of the circuit, with the magnetic fields being oriented parallel with the pivot axis and having their north poles pointed in the same direction.

11 Claims, 5 Drawing Sheets

ARC EXTINCTION APPARATUS AND DC SWITCH APPARATUS

BACKGROUND

1. Field

The disclosed and claimed concept relates generally to an electrical switching apparatus and, more particularly, to an arc extinction apparatus for a DC switch apparatus.

2. Related Art

Numerous types of circuit interrupters are known for use in diverse applications. In certain applications, such as low power situations, the circuit interrupter can be as simple as a mechanical switch, of which many types are known.

One type of mechanical switch that is employed in somewhat higher voltage and current applications involves the use of a rotatable shaft upon which an elongated conductor is mounted. The ends of the conductor are electrically connected with a pair of contacts when the circuit interrupter is in an ON condition. When the circuit interrupter is moved toward its OFF condition, the shaft is rotated, which causes the elongated conductor to pivot about the pivot axis about the shaft, which causes air gaps to form between the ends of the elongated conductor and the pair of contacts. While such circuit interrupters have been generally effective for their intended purposes, they have not been without limitation.

Certain applications involve DC circuits, and it has become desirable in certain applications, such as photovoltaic applications, to increase the voltage and current flowing within a circuit, which consequently increases the difficulty of extinguishing arcs that form at the air gaps when switching a circuit interrupter from an ON condition to an OFF condition. For example, it has become desirable in photovoltaic applications to increase the number of solar arrays arranged in parallel and in series which increases current and voltage, respectively, which must be interrupted by a circuit interrupter. Moreover, depending upon the orientation of the contacts in relation to one another and in relation to the elongated conductor, it is possible that the arc created at the air gap can tend to move along the elongated conductor toward the pivot axis of the shaft. Movement of the arc toward the pivot axis of the shaft on which the elongated conductor is mounted tends to shorten the arc and to reinforce it, which is undesirable since any arc is preferably extinguished as soon as possible. While efforts have been made to employ magnets in extinguishing arcs in such circuit interrupters, the result has been a circuit interrupter that can only interrupt DC power in a given polarity. That is, such a circuit interrupter cannot interrupt DC current flowing in an opposite direction with reverse polarity through the circuit interrupter. It thus would be desirable to provide an improved circuit interrupter that provides improved performance.

SUMMARY

An improved arc extinction apparatus that can be used in an improved DC switch apparatus includes a pair of magnetic field elements in the form of permanent magnets or other magnets to apply Lorentz forces to the arcs. The magnetic fields are arranged in the vicinity of the air gaps that form between the ends of a pivoting conductor and a pair of contacts such that the system is optimized to extinguish an arc at one air gap when current is flowing through the conductor in a first direction and is further optimized to extinguish an arc at the other air gap when current is flowing in an opposite direction through the conductor. This is accomplished by providing a magnet at each air gap of the circuit, with the magnetic fields being oriented parallel with the pivot axis and having their north poles pointed in the same direction.

Accordingly, an aspect of the disclosed and claimed concept is to provide an improved arc extinction apparatus that can be installed in a DC switch apparatus or other switch apparatus in order to form an improved DC switch apparatus.

Another aspect of the disclosed and claimed concept is to provide an improved arc extinction apparatus and an improved DC switch apparatus that enable the interruption of DC power of either polarity flowing through the circuit that is being interrupted.

Another aspect of the disclosed and claimed concept is to provide an improved arc extinction apparatus and an improved DC switch apparatus in which each circuit that is to be interrupted has a pair of contacts that are electrically connected with a movable elongated conductor, wherein a magnetic field element generates a magnetic field that is optimized to extinguish an arc at an air gap when the DC switch apparatus is connected in a first polarity, and wherein another magnetic field element at the other contact generates another magnetic field that is optimized to extinguish an arc at another air gap when the DC switch apparatus is connected with a different polarity.

Accordingly, an aspect of the disclosed and claimed concept is to provide an improved arc extinction apparatus structured for use in a DC switch apparatus that is structured to be connected with a number of circuits. The DC switch apparatus has a shaft and further has, for each circuit to which the DC switch apparatus is structured to be connected, an elongated conductor mounted to the shaft and connectable at its opposite ends with a pair of contacts in the circuit. The shaft is pivotable about a pivot axis between a first position in which the ends of the conductor are electrically connected with a corresponding pair of contacts and a second position in which a pair of air gaps exists between the conductor and the corresponding pair of contacts. The arc extinction apparatus can be stated as including, for each circuit to which the DC switch apparatus is structured to be connected, a pair of magnetic field elements structured to be situated adjacent the pair of contacts and to generate a pair of magnetic fields oriented parallel with the pivot axis and having their north poles pointed in the same direction. Such an arrangement of magnetic field elements likewise results in their south poles all being pointed in the same, albeit different, direction Other aspects of the disclosed and claimed concept are provided by an improved method of enabling a DC switch apparatus to interrupt direct current flowing in either direction through a number of circuits with which the DC switch apparatus is structured to be connected. The DC switch apparatus has a shaft and further has, for each circuit to which the DC switch apparatus is structured to be connected, an elongated conductor mounted to the shaft and connectable at its opposite ends with a pair of contacts in the circuit. The shaft is pivotable about a pivot axis between a first position in which the ends of the conductor are electrically connected with a corresponding pair of contacts and a second position in which a pair of air gaps exists between the conductor and the corresponding pair of contacts. The method can be stated as including, for each circuit to which the DC switch apparatus is structured to be connected, installing a pair of magnetic field elements within the DC switch apparatus adjacent the pair of contacts; and generating with the pair of magnetic field elements a pair of magnetic fields oriented parallel with the pivot axis and having their north poles pointed in the same direction. Such a switch apparatus may employ multiple poles in series or parallel.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
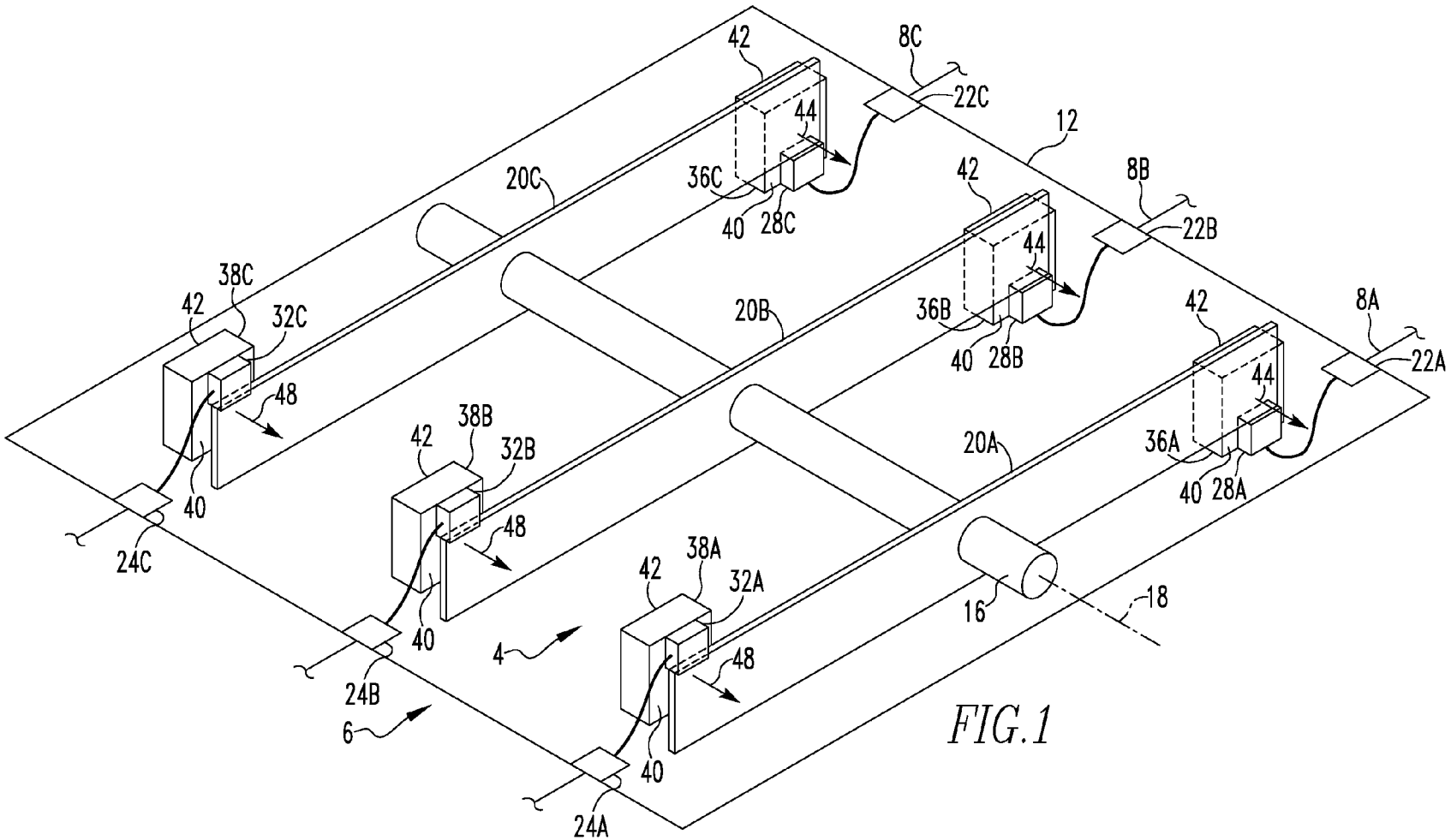
FIG. 1 is a schematic depiction of an improved arc extinction apparatus installed on an improved DC switch apparatus in an ON condition.
Figure 2:
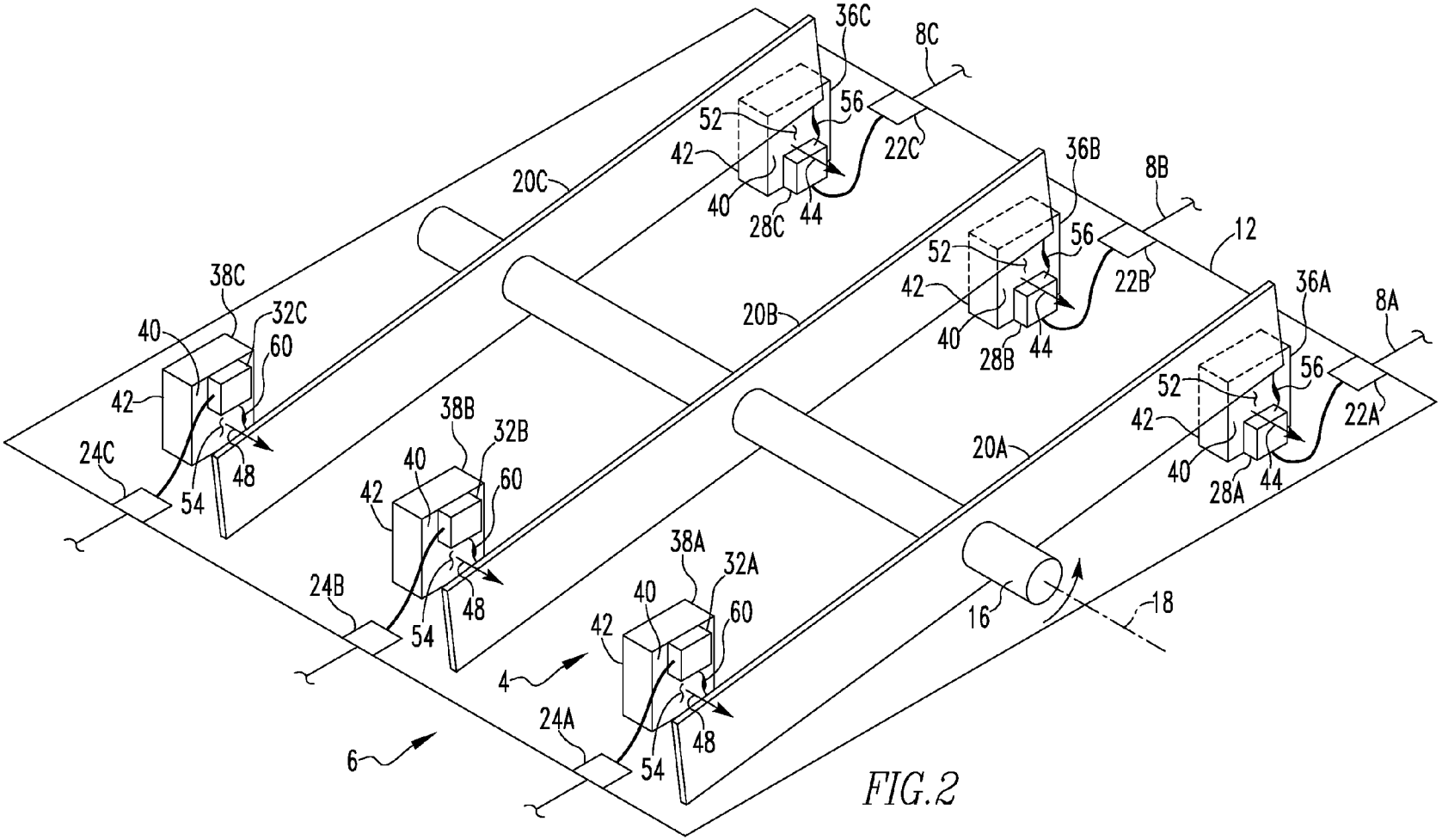
FIG. 2 is a view similar to FIG. 1, except depicting the DC switch apparatus moving away from the ON condition toward an OFF condition.

FIGS. 1 and 2 depict in a schematic fashion an improved arc extinction apparatus 4 installed on a multiple-circuit DC switch apparatus to form an improved DC switch apparatus 6. It is expressly noted that the arc extinction apparatus 4 can be employed to retrofit an existing DC switch apparatus to form an improved DC switch apparatus such as the improved DC switch apparatus 6, as will be set forth in greater detail below. In particular, the DC switch apparatus 6 is connected with a number of circuits that are collectively referred to herein with the numeral 8. As employed herein, the expression "a number of"and variations thereof shall refer broadly to any non-zero quantity, including a quantity of one. More particularly, the DC switch apparatus 6 is connected with three circuits 8 in the depicted exemplary embodiment that are given the numerals 8A, 8B, 8C.

The DC switch apparatus 6 can be said to include a housing 12 upon which an elongated shaft 16 is rotatably disposed. The shaft 16 pivots about a pivot axis 18. The DC switch apparatus 6 further includes, for each circuit 8 to which the DC switch apparatus 6 is connected, an elongated conductor indicated generally at the collective numeral 20. In the exemplary embodiment depicted herein, therefore, the conductors 20 include three conductors 20A, 20B, 20C that correspond, respectively, with the three circuits 8A, 8B, and 8C, i.e., one conductor 20 per circuit 8 to which the DC switch apparatus 6 is connected.

The DC switch apparatus 6 further includes-a first terminal 22, a second terminal 24, a first contact 28, and a second contact 32 (collective reference numbers) associated with each circuit 8. That is, conductor 20A is associated with a first terminal 22A, a second terminal 24A, a first contact 28A, and a second contact 32A; the conductor 20B is associated with a first terminal 22B, a second terminal 24B, a first contact 28B, and a second contact 32B; and the conductor 20C is associated with a first terminal 22C, a second terminal 24C, a first contact 28C, and a second contact 32C. The first and second terminals 22 and 24, and the first and second contacts 28 and 32 are disposed on the housing 12.

The shaft 16 and the conductors 20 are movable between an ON condition of the DC switch apparatus 6, as is indicated generally in FIG. 1, and an OFF condition of the DC switch apparatus 6, as is indicated generally in FIG. 2. In the ON condition of FIG. 1, the conductors 20 are electrically connected at their ends with the first and second terminals 22 and 24. The first terminal 22 of each conductor 20 is electrically connected with the first contact 28 of the conductor 20, and the second terminal 24 of each conductor 20 is likewise electrically connected with the second contact 32 of the conductor 20. In the ON condition of the DC switch apparatus 6, therefore, an electrically conductive path extends between the first and second terminals 22 and 24, with each such conductive path additionally including the first and second contacts 28 and 32 and the conductor 20.

The arc extinction apparatus 4 includes a pair of magnetic field elements for each conductor 20 that are each structured to generate a magnetic field. In the exemplary embodiment depicted herein, the pair of magnetic field elements that are associated with each conductor 20 are a first magnet 36 and a second magnet 38 that are both in the exemplary form of permanent magnets. The first and second permanent magnets 36 and 38 (collective numerals) can be of any type and may be, for example, rare earth magnets formed from samarium cobalt, neodymium, or other material without limitation. It is also noted that the magnetic field elements could be in other forms, such as in the form of electromagnets and the like without limitation.

The first and second magnets 36 and 38 each include a north pole 40 and a south pole 42 which, in the depicted exemplary embodiment, are opposite one another. The first magnets 36 thus each generate a first magnetic field represented in FIGS. 1 and 2 by the magnetic field vector 44 which extends out of the north pole 40, and the second magnets 38 generate a second magnetic field represented in FIGS. 1 and 2 by a second magnetic field vector 48 which extends out of the north pole 40. The north poles 40 of the first and second magnets 36 and 38 that are associated with any given conductor 20 both have their north poles 40 facing in the same direction, i.e., in a common direction. Moreover, the first and second magnetic fields 44 and 48 associated with any given conductor 20 are parallel with one another and with the pivot axis 18 of the shaft 16. The first and second magnetic field vectors 44 and 48 thus can likewise be said to be pointed in the same direction, i.e., a common direction. For the sake of completeness, it is observed that in such an environment the south poles 42 likewise all face in the same direction, i.e., in a common direction, although the direction in which the south poles 42 are directed is different from the direction in which the north poles 40 are directed.

As can be understood from FIG. 2, when the DC switch apparatus 6 is moved away from its ON position and toward its OFF position, the ends of the conductors 20 are disengaged from physical contact with the associated first and second contacts 28 and 32, thus forming a first air gap 52 between the conductor 20 and the associated first contact 28 and further creating a second air gap 54 between the conductor 20 and the associated second contact 32. Moreover, if a given circuit 8 is energized when the DC switch apparatus 6 is moved from its ON condition toward its OFF condition, a first arc 56 typically forms across the first air gap 52, and a second arc 60 typically forms across the second air gap 54. As will be described in greater detail below, the arc extinction apparatus 4 is advantageously configured to apply Lorentz forces to an arc at the first air gap 52 when the DC switch apparatus 6 is connected in a first DC polarity and to apply Lorentz forces to extinguish an arc at the second air gap 54 when the DC switch apparatus 6 is connected in a second, opposite DC polarity.

Figure 3A:
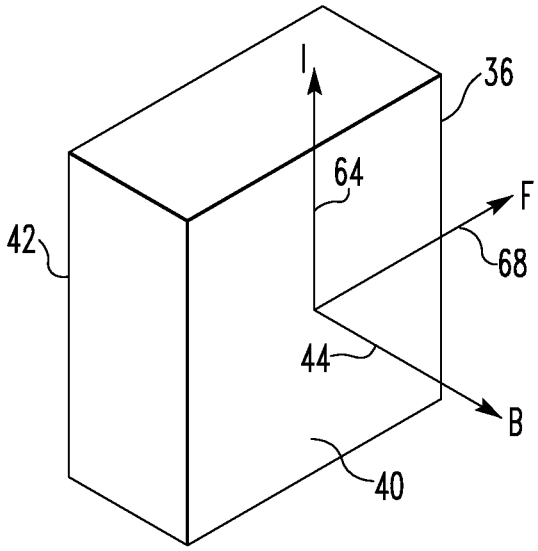
FIGS. 3A and 3B depict Lorentz force vectors that are applied to a portion of an electrical arc in the presence of a magnetic field, with FIG. 3A depicting current flowing in one polarity and with FIG. 3B depicting current flowing in an opposite polarity.
Figure 3B:
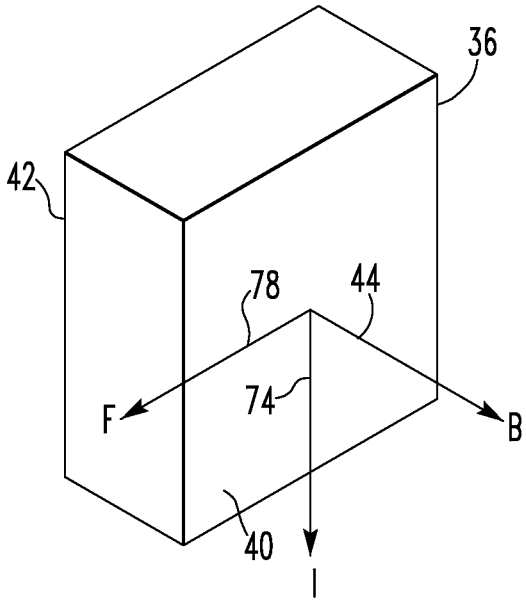

As is generally understood, a charged particle that passes through a magnetic field will be subjected to Lorentz forces in a third direction. A magnetic field that is depicted in FIGS. 3A and 3B as emanating from the north pole 40 of a first magnet 36 is represented by the first magnetic field vector 44. If a charged particle is moving, as is indicated with a current vector 64 in FIG. 3A, in a direction perpendicular to the first magnetic field vector 44, the charged particle will be subjected to Lorentz forces represented by the Lorentz force vector 68 in FIG. 3A according to the well understood Right Hand Rule. By way of example, if the direction of the current vector 64 is perpendicular to the first magnetic field vector 44, the resultant Lorentz force vector 68 will be perpendicular to both the current vector 64 and the first magnetic field vector 44, meaning that the current vector 64, the first magnetic field vector 44, and the Lorentz field vector 68 will be mutually orthogonal. Of course, if the actual path of the charged particle is not perpendicular to the magnetic field vector 44, the component of the movement that actually is perpendicular to the magnetic field vector is used in determining the resultant Lorentz force in the mutually orthogonal direction. For the sake of completeness, it is noted that the Lorentz force on a point charge due to an electromagnetic field can be generally said to follow the following equation:

$$F=q\,[E+(v\times B)]$$

where

F is the Lorentz force (say, in Newtons);

E is the electric fields (say, in volts per meter);

B is the magnetic field (say, in Teslas);

q is the electric charge of the particle (say, in Coulombs);

v is the velocity of the particle (say, in meters per second); and x is the vector cross product.

It is also noted that the force on a current carrying wire due to an electromagnetic field can be referred to as a Laplace Force, which can generally be said to follow the following equation:

$$F=I\,L\times B$$

where

F is the Laplace force (say, in Newtons);

I is the current in the wire (say, in Amperes);

B is the magnetic field (say, in Teslas);

L is a vector, whose magnitude is the length of wire (measured, say, in meters), and whose direction is along the wire, aligned with the direction of conventional current flow (say, in meters per second); and x is the vector cross product.

FIG. 3A depicts the first magnetic field vector 44 as pointing directly out of the north pole 40 of the first magnet 36. The current vector 64 represents the direction of current in an electrical arc that extends across the magnetic field vector 44 when the DC switch apparatus 6 is connected with DC current having a first polarity. The resultant Lorentz force is depicted in the indicated direction with the Lorentz force vector 68.

However, if the direction of the current is reversed in the presence of the same magnetic field, as is indicated in FIG. 3B where the first magnetic field vector 44 is oriented in the same direction with respect to the first magnet 36 but the current is represented by a current vector 74 pointing in an opposite direction, the resultant Lorentz force on the charged particle is represented by another Lorentz force vector 78 which is mutually orthogonal to the current vector 74 and the first magnetic field vector 44. However, since the current vector 74 of FIG. 3B is opposite the current vector 64 of FIG. 3A, in the presence of the same first magnetic field 48 the resultant Lorentz force vector 78 of FIG. 3B is opposite the Lorentz force vector of FIG. 3A.

It thus can be seen from FIGS. 3A and 3B that in an environment where a magnetic field element such as the first magnet 36 generates a magnetic field such as is indicated with the first magnetic field vector 44, if the direction of the current is reversed, the resultant Lorentz force likewise is reversed. The Lorentz forces that are changed in direction between FIGS. 3A and 3B in response to a change in the direction of the current between FIGS. 3A and 3B is further applied to a portion the DC switch apparatus 6 in FIGS. 4 and 5.

Figure 4:
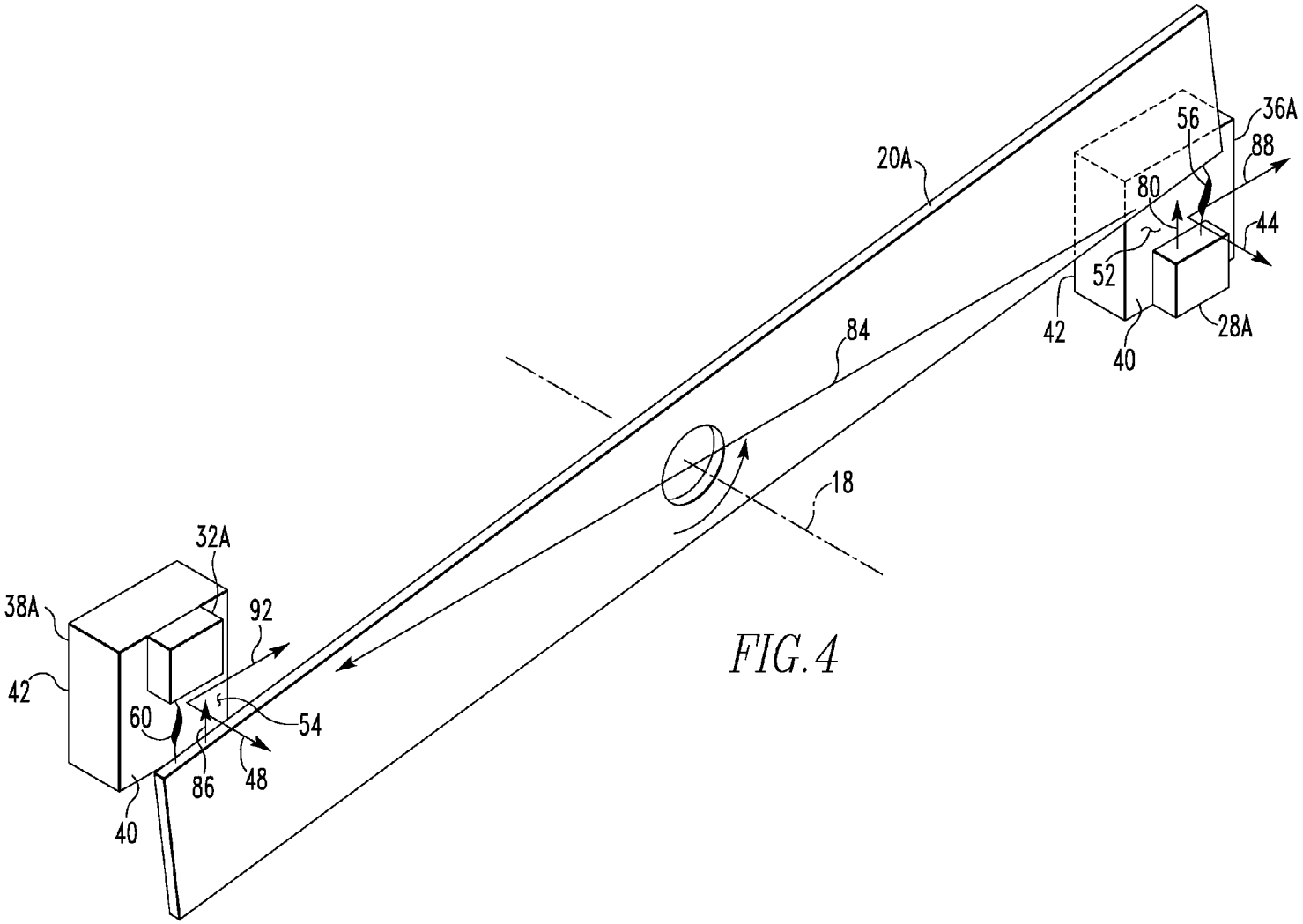
FIG. 4 is an enlarged depiction of a set of magnets of the arc extinction apparatus of FIG. 2 and a set of contacts of the DC switch apparatus of FIG. 2 depicting the Lorentz forces that act upon an arc formed at the air gaps between the contacts and an elongated conductor of the DC switch apparatus, with current in a first polarity.

More particularly, FIG. 4 depicts the conductor 20A and the corresponding first and second contacts 28A and 32A when the DC power connected thereto has a first polarity. Direct current (DC) that flows from the first contact 28A to the conductor 20A in the form of a number of charged particles in the first arc 56 is represented by a current vector indicated at the numeral 80. Current flowing in the conductor 20A from the first contact 28A toward the second contact 32A and, more particularly, from the first arc 56 to the second arc 60, is indicated by a current vector represented at the numeral 84. Finally, current flowing from the conductor 20A toward the second contact 32A in the form of a number of charged particles flowing in the second arc 60 is represented by a current vector indicated at the numeral 86.

As can be seen in the vicinity of the first air gap 52 in FIG. 4, when the current 80 is in the presence of the first magnetic field vector 44 of the first magnet 36A, the first arc 56 is subjected to a first Lorentz force as represented by a first Lorentz force vector 88. The first Lorentz force vector 88 is oriented in a direction away from the pivot axis 18 of the shaft 16. Such Lorentz forces 88 tend to move the first arc 56 in a direction along the conductor 20 that will lengthen the first arc 56 and tend to extinguish it. That is, from the geometry of the first contact 28A and the conductor 20A in FIG. 4 and the resultant current vector 80 along the first arc 56, which is in the presence of the first magnetic field vector 44, the resultant first Lorentz force 88 is applied to the first arc 56 and pushes the first arc 56 in an extinguishing direction.

Moreover, when the current vector 86, as represented by the second arc 60, passes through a second magnetic field, as represented by the second magnetic field 48 generated by the second magnet 38A, the second arc 60 is subjected to a second Lorentz force as is represented by a second Lorentz force vector 92 in the direction indicated in FIG. 4.

The first and second Lorentz force vectors 88 and 92 are in the same direction. However, since the first and second Lorentz force vectors 88 and 92 are situated at opposite sides of the pivot axis 18, the first and second Lorentz force vectors 88 and 92 can be said to have different effects on the first and second arcs 56 and 60, respectively. Whereas the first Lorentz force 88 is in a direction generally away from the pivot axis 18, it tends to extinguish the first arc 56 by pushing it an elongating direction. However, the second Lorentz force 92 pushes the second arc 60 in a direction generally toward the pivot axis 18, which is not necessarily in an extinguishing direction.

It is noted, however, that the extinguishing of either of the first arc 56 and the second arc 60 will result in extinction of the other. That is, current ceases to flow between the first and second terminals 22 and 24 when either the first arc 56 or the second arc 60 is extinguished, and the ceasing of current flow extinguishes any arcs that are remaining. Thus, the rapid extinction of the first arc 56 by the first Lorentz force 88 has the effect of extinguishing the second arc 60 regardless of the direction of the second Lorentz force vector 92 acting on the second arc 60. Stated otherwise, the voltage drop that the first arc 56 needed to overcome in FIG. 4 in order to continue to exists increased much more rapidly than the voltage drop experienced by the second arc 60, which resulted in the extinction of the first arc 56 which, in turn, resulted in extinction of the second arc 60. While FIG. 4 depicts only one of the conductors 20, it is understood that the same extinction occurs with all of the conductors 20 that are connected with the shaft 16.

Figure 5:
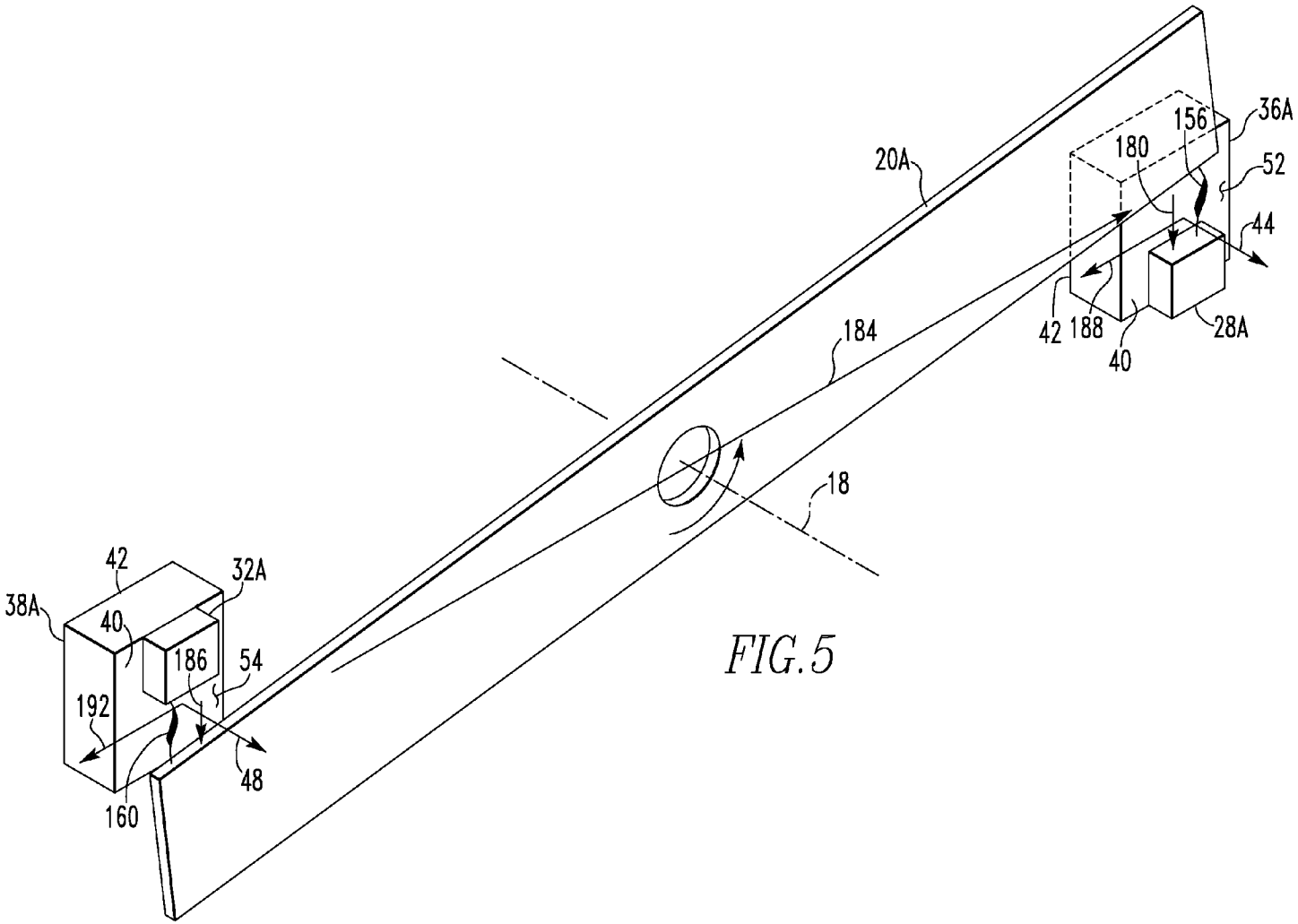
FIG. 5 is a depiction similar to FIG. 4, except depicting the Lorentz forces on arcs when current is connected with the DC switch apparatus in an opposite polarity.

When the DC switch apparatus 6 is connected in a reverse polarity, the arc extinction scenario is as depicted generally in FIG. 5. More particularly, the reverse polarity current flow in the circuit 8 of FIG. 5 includes a current vector 186 representing current flowing from the second contact 32A to the conductor 20A in the form of a second arc 160, another current vector 184 representing current flowing in the conductor 20A from the second contact 32A toward the first contact 28A, and another current vector 180 representing current flowing from the conductor 20A to the first contact 28A in the form of a first arc 156. As can be understood from a comparison between FIGS. 4 and 5, the current vector 80 in FIG. 4 is replaced with the current vector 180 in FIG. 5, which is in an opposite direction. Likewise, the current vector 86 in FIG. 4 is replaced with the current vector 186 in FIG. 5 which is likewise in an opposite direction. The first and second magnetic field vectors 44 and 48 are unchanged between FIGS. 4 and 5. However, since the current vectors 180 and 186 have been reversed from what is depicted in FIG. 4, the resultant Lorentz forces likewise are reversed. Specifically, the first arc 156 at the first air gap 52 experiences a first Lorentz force indicated by the first Lorentz force vector 188, which is in an opposite direction from the first Lorentz force vector 88 of FIG. 4. Similarly, the second arc 160 at the second air gap 54 is subjected to a second Lorentz force as is represented by the second Lorentz force vector 192, which is in an opposite direction from the second Lorentz force 92 which acted on the second arc 60 in FIG. 4.

While the first and second Lorentz force vectors 188 and 192 are in the same direction, i.e., in a common direction, they are situated at opposite sides of the pivot axis 18 of the shaft 16 and thus have different effects on the first and second arc 156 and 160, with the effects being different than the effects that were depicted generally in FIG. 4. More particularly, the first Lorentz force vector 188 acts on the first arc 156 to force it in a direction toward the pivot axis 18, which is not necessarily a lengthening direction. The first Lorentz force vector 188 thus has a different effect on the extinction of the first arc 156 than the effect of the first Lorentz force 88 on the first arc 56 in FIG. 4. However, the second Lorentz force vector 192 applies a force to the second arc 160 which is in a direction away from the pivot axis 18 and which is a lengthening, i.e., extinguishing, direction. As stated elsewhere herein, since the extinction of one arc will result in extinction of the other arc, the extinction of the second arc 160 by the second Lorentz force vector 192 has the effect of likewise extinguishing the first arc 156.

It thus can be seen that by arranging the first and second magnets 36 and 38 of the arc extinction apparatus 4 in a fashion to provide a pair of parallel first and second magnetic fields 44 and 48 for each circuit 8, with the north poles 40 facing the same direction, the DC switch apparatus 6 is advantageously able to interrupt direct current flowing through it in either direction, i.e., direct current with either polarity. This is achieved by optimizing the extinction of an arc at the first air gap 52 when current is flowing with a first polarity and by optimizing the extinction of the arc at the second air gap 54 when current is flowing with a second, opposite polarity. Since the extinction of one arc will result in extinction of the other arc, the optimization of the extinction of arcs at different air gaps depending upon the direction of the current flow results in the extinction of arcs at all air gaps regardless of the polarity of current flow. As such, the arc extinction apparatus 4 with its first and second magnets 36 and 38 for each circuit 8 to which the DC switch apparatus 6 is connected, provides expedited extinction of arcs across the first and second air gaps 52 and 54, which increases DC current interruption capability regardless of the direction of current flow.

Depending upon the geometry of the DC switch apparatus 6, it may be desirable to provide an increased magnetic field at the second air gap 54. For instance, in some environments the first contact 28 is situated vertically higher than the second contact 32 such that the air warmed by the arc has the effect of moving the first and second arcs 56 and 60 in an upward direction. If the first contact 28 is situated vertically higher than the second contact 32, such air warming will have the effect of moving the first arc 56 in an upward, extinguishing direction. However, such air warming will have the effect of further causing the second arc 60 to move toward the pivot axis 18, which is not necessarily an extinguishing direction. While this does not present a concern in the polarity environment of FIG. 4, it potentially can be of a concern in the reverse polarity environment of FIG. 5 where extinction of the second arc 160 at the second air gap 54 is relied upon to interrupt current flowing through the DC switch apparatus 6. The magnetic field 48 at the second air gap 54 thus may desirably be configured to be stronger than the magnetic field 44 at the first air gap 52 in order to overcome any such air warming effect. As such, the first magnetic field 44 having a field strength of 670 Gauss is typically sufficient to extinguish arcs at the first air gap 52 sufficient to interrupt 200 amps of current at 600 volts DC in a three circuit environment. On the other hand, the second magnetic field 48 may desirably be more on the order of 950 Gauss in order to extinguish arcs at the second air gap 54 sufficient to interrupt the same current and voltage in the reverse current environment, such as is depicted generally in FIG. 5.

It is also noted that the first and second magnets 36 and 38 can be arranged differently than depicted generally herein. Whereas the first and second magnets 36A and 38A are depicted herein at the same side of the conductor 20A, for example, it is noted that in alternate embodiments the first and second magnets 36 and 38 could be disposed at alternate sides or both at the opposite side of the corresponding conductor. This is so long as the north poles 40 of the first and second magnets 36 and 38 are oriented in the same direction. Also, the first and second magnets 36 and 38 can be spaced from the first and second air gaps 52 and 54 a distance greater than depicted herein so long as the first and second magnets 36 and 38 are configured to generate magnetic fields of sufficient strength to achieve the advantageous arc extinction mentioned above.

It is further noted that Gauss values vary greatly with distance from a source of a magnetic field, and the exemplary Gauss values presented herein are effective in an environment of relatively close spacing between a magnetic field element and an air gap as indicated herein. It thus is understood that it may be necessary to employ magnetic field elements having relatively greater Gauss values than those expressly discussed herein based upon the particular spacing that exists in the specific environment in which the teachings presented herein are employed.

The positioning of the first and second magnets 36 and 38 with respect to any given corresponding conductor 20, i.e., both at the first side, both at the second side, or disposed at alternate sides, need not be consistent among the various conductors 20A, 20B, and 20C within the DC switch apparatus 6. For instance, while the first and second magnets 36A and 38A are depicted as being situated at one side of the conductor 20A, it is noted that in other embodiments the first and second magnets 36B and 38B could be both situated at the other side of the conductor 20B, and the first and second magnets 36C and 38C could be disposed at alternate sides of the conductor 20C, by way of example. Other examples will be apparent to those of skill in the art.

The improved arc extinction apparatus 4 can thus be added to a DC switch apparatus to form the improved DC switch apparatus 6 described herein. The arc extinction apparatus 4 advantageously enables the DC switch apparatus 6 to have an increased current interruption level independent of the polarity of the DC current flow by separately optimizing the magnetic fields 44 and 48 at the first and second air gaps 52 and 54 to interrupt an arc in differing polarity applications.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An arc extinction apparatus structured for use in a DC switch apparatus that is structured to be connected with a number of circuits, the DC switch apparatus having a shaft and further having, for each circuit to which the DC switch apparatus is structured to be connected, an elongated conductor mounted to the shaft and connectable at its opposite ends with a pair of contacts in the circuit, the shaft being pivotable about a pivot axis between a first position in which the ends of the conductor are electrically connected with a corresponding pair of contacts and a second position in which a pair of air gaps exists between the conductor and the corresponding pair of contacts, the arc extinction apparatus comprising for each circuit to which the DC switch apparatus is structured to be connected:

a pair of magnetic field elements structured to be situated adjacent the pair of contacts and at the same side of the conductor and to generate a pair of magnetic fields oriented parallel with the pivot axis and having their north poles pointed in the same direction.

2. The arc extinction apparatus of claim 1 wherein the pair of magnetic field elements are permanent magnets.

3. The arc extinction apparatus of claim 1 wherein the pair of magnetic fields are structured to simultaneously subject at least a portion of each of a pair of electrical arcs at the air gaps to Lorentz forces in the same direction.

4. The arc extinction apparatus of claim 1 wherein:

a magnetic field of the pair of magnet fields is structured to subject at least a portion of an electrical arc at an air gap of the pair of air gaps to Lorentz forces in a first direction away from the pivot axis when the current is flowing in one direction through the conductor; and the other magnetic field of the pair of magnet fields is structured to subject at least a portion of another electrical arc at the other air gap of the pair of air gaps to Lorentz forces in a second direction away from the pivot axis when the current is flowing in a reverse direction through the conductor.

5. The arc extinction apparatus of claim 4 wherein the first direction away from the pivot axis and the second direction away from the pivot axis are opposite one another.

6. A DC switch apparatus employing the arc extinction apparatus of claim 1.

7. A method of enabling a DC switch apparatus to interrupt direct current flowing in either direction through a number of circuits with which the DC switch apparatus is structured to be connected, the DC switch apparatus having a shaft and further having, for each circuit to which the DC switch apparatus is structured to be connected, an elongated conductor mounted to the shaft and connectable at its opposite ends with a pair of contacts in the circuit, the shaft being pivotable about a pivot axis between a first position in which the ends of the conductor are electrically connected with a corresponding pair of contacts and a second position in which a pair of air gaps exists between the conductor and the corresponding pair of contacts, the method comprising for each circuit to which the DC switch apparatus is structured to be connected:

installing a pair of magnetic field elements within the DC switch apparatus adjacent the pair of contacts and at the same side of the conductor; and generating with the pair of magnetic field elements a pair of magnetic fields oriented parallel with the pivot axis and having their north poles pointed in the same direction.

8. The method of claim 7, further comprising providing as the pair of magnetic field elements a pair of permanent magnets.

9. The method of claim 7, further comprising employing the pair of magnetic fields to simultaneously subject at least a portion of each of a pair of electrical arcs at the air gaps to Lorentz forces in the same direction.

10. The method of claim 7, further comprising:

employing a magnetic field of the pair of magnet fields to subject at least a portion of an electrical arc at an air gap of the pair of air gaps to Lorentz forces in a first direction away from the pivot axis when the current is flowing in one direction through the conductor; and employing the other magnetic field of the pair of magnet fields to subject at least a portion of another electrical arc at the other air gap of the pair of air gaps to Lorentz forces in a second direction away from the pivot axis when the current is flowing in a reverse direction through the conductor.

11. The method of claim 10 wherein the first direction away from the pivot axis and the second direction away from the pivot axis are opposite one another.

* * * * *